United States Patent [19]

Olson

[11] Patent Number: 4,656,430

[45] Date of Patent: Apr. 7, 1987

[54] SHORT RISE TIME INTENSE ELECTRON BEAM GENERATOR

[75] Inventor: Craig L. Olson, Albuquerque, N. Mex.

[73] Assignee: The United States of America as represented by the United States Department of Energy, Washington, D.C.

[21] Appl. No.: 590,317

[22] Filed: Mar. 16, 1984

[51] Int. Cl.[4] ..... H01J 29/70

[52] U.S. Cl. ..... 328/229; 315/3; 315/4; 315/39; 328/64; 328/227

[58] Field of Search ..... 328/63, 64, 65, 227, 328/228, 229, 220; 315/3, 4, 5, 39; 331/79, 81

[56] References Cited

U.S. PATENT DOCUMENTS

| | | | |
|---|---|---|---|
| 2,982,917 | 5/1961 | Aaland et al. | 328/229 |
| 3,234,427 | 2/1966 | Orthuber | 315/4 |
| 3,309,557 | 3/1967 | Crowley-Milling | 328/64 X |
| 3,360,678 | 12/1967 | Kerns | 315/3 |
| 3,482,139 | 12/1969 | Leboutet et al. | 315/5 X |
| 3,489,944 | 1/1970 | Denholm et al. | 328/227 |
| 3,720,828 | 3/1973 | Nablo | 328/228 |
| 4,150,340 | 4/1979 | Kapetanakos et al. | 315/3 |
| 4,215,291 | 7/1980 | Friedman | 315/4 |
| 4,345,220 | 8/1982 | Sullivan | 315/39 |

*Primary Examiner*—Saxfield Chatmon

*Attorney, Agent, or Firm*—George H. Libman; Albert Sopp; Judson R. Hightower

[57] ABSTRACT

A generator for producing an intense relativistic electron beam having a subnanosecond current rise time includes a conventional generator of intense relativistic electrons feeding into a short electrically conductive drift tube including a cavity containing a working gas at a low enough pressure to prevent the input beam from significantly ionizing the working gas. Ionizing means such as a laser simultaneously ionize the entire volume of working gas in the cavity to generate an output beam having a rise time less than one nanosecond.

10 Claims, 3 Drawing Figures

SHORT RISE TIME INTENSE ELECTRON BEAM GENERATOR

BACKGROUND OF THE INVENTION

The present invention relates generally to an intense relativistic electron beam generator and more particularly to an electron beam generator using a beam switch to decrease the rise time of the generated electron beam. The U.S. Government has rights in this invention pursuant to Contract No. DE-AC04-76DP00789 between the Department of Energy and Sandia Corporation.

Many intense relativistic electron beam (IREB) generators provide outputs having current rise times on the order of 10 to 50 nanoseconds. However, for applications such as collective ion accelerators or electron beam propagation studies, it is desirable to have a rise time as small as possible. Previous methods for steepening the rise time of an IREB include use of beam conditioning cells or magnetic cores. Beam conditioning cells have been used to reduce the rise time of an IREB to 2–3 nanoseconds. The use of magnetic cores to produce similar results has been suggested, but not yet demonstrated. Thus, previous methods have not been able to reduce current rise times to subnanosecond levels.

SUMMARY OF THE INVENTION

It is an object of this invention to provide an IREB generator with an output switch which steepens the rise time of the generator.

It is another object of this invention to provide an IREB having a subnanosecond current rise time.

Additional objects, advantages and novel features of the invention will become apparent to those skilled in the art upon examination of the following description of may be learned by practice of the invention. The objects and advantages of the invention may be realized and attained by means of the instrumentalities and combinations particularly pointed out in the appended claims.

To achieve the foregoing in other objects and in accordance with the purpose of the present invention, as embodied and broadly described herein, the intense electron beam generator of this invention may comprise a conventional IREB generator for generating an electron beam having a long rise time, $t_r$; a short cylindrical electrically conductive drive tube forming a cavity containing a working gas at a low enough pressure to prevent the input beam from significantly ionizing the gas until time $t_s$, which is greater than $t_r$; and ionizing means for simultaneously and suddenly ionizing the volume of working gas in the drift tube after time $t_r$ and before time $t_s$, thereby generating the output beam. An input end of the drift tube is arranged to receive the beam from the generator and an output end is arranged to pass the IREB having a short rise time.

BRIEF DESCRIPTION OF THE DRAWINGS

The accompanying drawings, which are incorporated in and form a part of the specification, illustrate an embodiment of the present invention and, together with the description, serve to explain the principles of the invention.

DETAILED DESCRIPTION OF THE INVENTION

Figure 1:
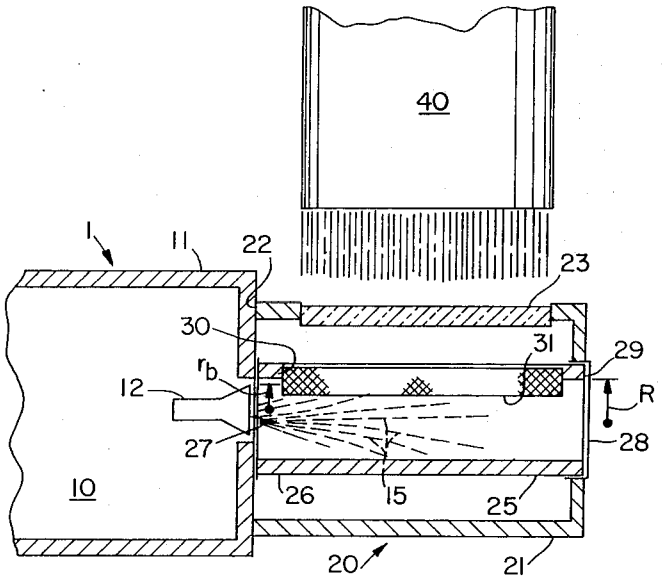
FIG. 1 is a side view of the invention.
Figure 2:
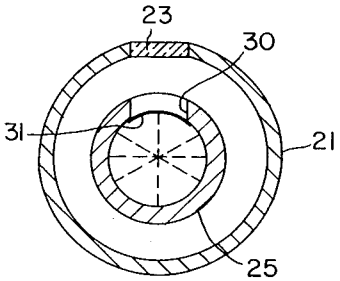
FIG. 2 is a cross-sectional view of the switch.

In accordance with the preferred embodiment of the invention detailed below, a generator 1 for producing an intense relativistic electron beam having a short current rise time includes conventional generating means 10 for generating an intense relativisitc input electron beam. This generator may typically comprise a Marx generator, a Blumlein, a Blumlein switch, and a diode that includes a cathode and an anode foil. As shown in FIG. 1, the output end of such a generator typically includes a vacuum enclosing housing 11, an electron beam emitting cathode 12, and an anode foil 27. The output of generator 10 from anode foil 27 is an intense relativistic electron beam 15 having a radius $r_b$ typically on the order of 1–3 cm, and a rise time $t_r$ on the order of 10 to 50 nanoseconds. FIG. 1 is not drawn to scale, as the radius of housing 11 may typically be on the order of 20–50 cm.

In accordance with this invention, operatively connected to the output of generator 10 is switch 20 for decreasing the rise time of the intense electron beam. As shown in the embodiment of FIG. 1, switch 20 includes a cylindrical vacuum housing 21 having end 22 abutting and forming a vacuum tight seal with housing 11 of generator 10. An alternate construction (not shown) uses an electrically conductive transfer tube up to several meters long, containing a gas at a moderate pressure to ensure efficient beam transport. The transfer tube connects the output of foil 27 with another foil (not shown) at the input end of switch 20. This alternate construction permits the switch to be spaced from the relatively large generator 10.

Also forming part of switch 20 and enclosed within housing 21 is a short, cylindrical, electrically conductive drift tube 25 axially aligned with electron beam 15 and having a radius R equal to or greater than $r_b$. Tube 25 typically has a length greater than about 2.4(R) as explained hereinafter. The output end 28 of tube 25 is covered by a second aluminum foil 29 which forms a vacuum tight enclosure with vacuum housing 21 as shown.

Included in drift tube 25 is an elongated window 30 forming an opening extending essentially from the input to the output ends of the tube and parallel to the axis thereof. Window 30 is covered by a conductive mesh 31 electrically connected to either the inside or outside surface of tube 25. Mesh 31 is typically a piece of copper screen that is approximately 75 percent transparent to impinging light.

The volume within housing 21 contains a special working gas having a low photoionization energy threshold and a large photoionization cross-section. Ideally, this working gas should exist in vapor form at a reasonable temperature. The gas in the drift tube is slowly ionized by the input beam, the beam propagating down the tube when the gas plasma density $n_p$ is equal to the input beam density $n_b$. If no external ionization source is provided, this propagation occurs at time $t_s$, which time varies inversely with the pressure of the gas (i.e., the lower the pressure, the longer until the input beam propagates). For this invention, the gas pressure is set so that $t_s$ is longer than the rise time $t_r$ of the current of input beam 15.

In the operation of this invention, input beam 15 is injected into drift tube 25 where it stops and diverges to the interior walls of the tube due to its own space charge, as the IREB parameters and drift tube dimensions are chosen so that $I_e$ is greater than $I_l$, where $I_e$ is the injected beam current and $I_l$ is the space charge limiting current. (The space charge limiting current is that current which, if it could propagate, would set up a repelling electric potential just strong enough to stop any following beam electrons from propagating.) The significance of making drift tube 25 at least 2.4(R) long or longer is that a tube of this length is sufficiently long to prevent the input beam with $I_e$ greater than $I_l$ from penetrating the entire tube and leaving the output end.

The principle upon which this invention works is as follows: The input electron beam is aimed to flow down the axis of drift tube 25. When the beam is injected, the working gas pressure is so low that the electron beam does not significantly ionize the gas; rather, the high density of the beam electrons creates a large negative charge inside the drift tube that causes the beam to diverge rapidly to the walls. The space charge may be so large that electrons injected on axis are actually repelled backwards through the anode foil. Therefore, in this initial state, the beam electrons enter the tube, are deflected by the space charge, and impact the interior wall and mesh of tube 25.

The beam continues to flow to the walls in this manner until an ionizing means (typically one or more lasers) is used to suddenly photoionize the entire volume of the working gas inside the drift tube up to a plasma density $n_p$. The desired plasma density $n_p$ should be about equal to the injected electron beam density $n_b$. The plasma that is created consists of plasma ions and plasma electrons. The plasma electrons experience the large repelling forces created by the beam electrons. The plasma electrons are quickly repelled out to the walls and are, therefore, removed from the working gas region. The remaining plasma ions are positively charged, and have a charge density roughly equal to the electron beam density, resulting in roughly no net charge density—a condition known as charge neutrality. Therefore, the electron beam no longer sees large repelling forces and is free to propagate directly through the drift tube.

The directed electron beam also has a large electric current, and the resultant beam self-magnetic field tends to hold the beam together as it propagates through the drive tube.

Thus, if the working gas is photoionized in a very short time (less than 1 nanosecond), then the electron beam will change from its "stopped state" to a "propagating state" in roughly the same time. The laser, therefore, acts to switch the electron beam "on". The remainder of the electron beam then flows freely through the tube. The net effect is that the slow rise time of the input electron beam has been chopped off, and the output beam now has a very short rise time.

In a preferred embodiment, laser 40 is provided outside vacuum housing 21 for photoionizing the gas inside tube 25. A window 23 in the outer surface of vacuum housing 21 provides optical communication from laser 40 through opening 30 in tube 25 to the working gas in which the input beam is dispersed. By providing a sufficient power density to photoionize the working gas on a fast time scale up to the electron beam density, the desired intense relativistic electron beam having a fast rise time is generated.

The actual pressure of the working gas is dependent upon the rise time of the input beam. A beam with a long rise time requires a lower pressure for the working gas then a shorter rise time beam since the longer rise time beam has more time to ionize the working gas.

Figure 3:
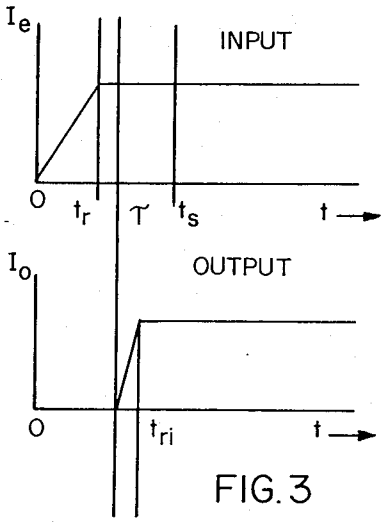
FIG. 3 shows the timing of events during operation of the invention.

The timing associated with the invention is shown in FIG. 3. The upper curve is a plot of input electron beam current $I_e$ as a function of time. If input generator 10 is initiated when t equals zero, the output rises with a rise time of $t_r$ of 10 to 50 nanoseconds and then levels off at a constant value. If the working gas is not photoionized before time $t_s$, then IREB-induced propagation of the gas begins to occur as a result of the pressure of the input beam. However, if at a time later than $t_r$ and prior to $t_s$ laser 40 is flashed through window 23 and opening 30 with sufficient energy to photoionize the working gas in a time less than one nanosecond, then an output pulse $I_o$ is generated through foil 29 having a rise time $t_{ri}$ of less than one nanosecond. Typical parameter values may be as follows. The injected IREB may have electron energies of 0.1–10 MeV, currents of 10–1000 kA, and a current rise time of 10–50 nsec. The working gas pressure might be 0.03 Torr which is a neutral gas density of $10^{15}$ $cm^{-3}$. The electron beam density may be $10^{12}$ $cm^{-3}$, and the laser(s) must photoionize the working gas only up to this same density. The working gas, therefore, only has to be ionized about 0.1 percent for the invention to operate. If the working gas is cesium and single step photoionization is used, a laser intensity of the order of 10 $MW/cm^2$ is needed for about 1 nanosecond at a wavelength at or below 318 nm. Alternatively, two-step photoionization of the working gas may be used to economize on laser power requirements.

Drift tube 25 must be conductive because if it is a dielectric, it will charge up, flash over, and become a plasma source. Ions from the plasma would be drawn into the IREB, and the IREB would begin to propagate before time $t_s$.

The particular components and equipment discussed above are cited merely to illustrate a particular embodiment of the invention. It is contemplated that the use of this invention may involve different components as long as the principle, using a switch to simultaneously ionize the entire volume of working gas in a drift tube, is followed. A generator so constructed will provide a relatively inexpensive and easy to construct source of intense relativisitic electron beams having a subnanosecond rise time. It is intended that the scope of the invention be defined by the claims appended hereto.

We claim:

1. A generator for producing an intense relativistic electron beam having a short current rise time, said generator comprising:

means for generating an intense relativistic input electron beam having a radius $r_b$, an injected beam current $I_e$, a density $n_b$ and a long rise time;

a short, cylindrical, electrically conductive drift tube of radius R greater than $r_b$ and a length greater than about 2.4(R), said tube including:

an input end for receiving said input beam;

a cavity containing a working gas at a low enough pressure to prevent the input beam from propagating through said working gas before $t_s$, the time at which said working gas has been ionized by said input beam to a plasma density equal to $N_b$, said beam being dispersed within said cavity and the space charge limiting current $I_l$ being less than $I_e$; and an output end for passing an intense relativistic output electron beam having a short rise time; and ionizing means for simultaneously and suddenly ionizing the entire volume of said working gas in said drift tube up to a plasma density equal to $n_b$ after said input beam has been generated and before $t_s$, thereby generating said output beam.

2. The generator of claim 1 wherein said ionizing means includes a photoionizing signal generator.

3. The generator of claim 2 wherein said photoionizing signal generator is a laser.

4. The generator of claim 1 wherein said working gas is Cs.

5. The generator of claim 3 wherein said means for generating said input beam has an anode foil output, and said tube:

is made of an electrically conductive rigid material having an elongated opening extend essentially the length of said tube;

has a conductive mesh covering said opening and electrically connected to said material with; and is covered at said input end by an electrically conductive anode foil spaced from said cathode for receiving said input beam and electrically connected to said tube material.

6. The generator of claim 5 wherein said tube is covered at said output end by another foil electrically connected to said tube material.

7. The generator of claim 5 wherein said anode and said output foils are formed of aluminum.

8. The generator of claim 5 wherein said laser output is directed at said dispersed beam through said mesh, the cross section of said laser output being at least as large as said opening.

9. The generator of claim 8 further including a vacuum chamber enclosing said tube, said chamber having a window aligned between said laser and said opening.

10. A method of generating an intense relativistic electron beam having a short current rise time comprising the steps of:

generating an intense relativistic input electron beam having a radius $r_b$, an injected beam current $I_e$, a density $n_b$ and a long rise time into a cavity containing a working gas at a low enough pressure to prevent the input beam from propagating through said working gas before $t_s$, the time at which said working gas has been ionized by said input beam to a plasma density equal to $N_b$, said beam being dispersed within said cavity and the space charge limiting current $I_l$ being less than $I_e$; and simultaneously and suddenly ionizing the entire volume of said working gas in said cavity up to a plasma density equal to $n_b$ after said input beam has been generated and before $t_s$, thereby generating an output beam.

* * * * *